US007853034B1

(12) United States Patent
Gresko

(10) Patent No.: US 7,853,034 B1
(45) Date of Patent: Dec. 14, 2010

(54) AMBIENT NOISE ISOLATION AUDIO HEADPHONES HAVING A LAYERED DAMPENING STRUCTURE

(76) Inventor: Johnny J. Gresko, 3740 N. Windmill Dr., Arnold, MO (US) 63010

( * ) Notice: Subject to any disclaimer, the term of this patent is extended or adjusted under 35 U.S.C. 154(b) by 1343 days.

(21) Appl. No.: 11/333,176

(22) Filed: Jan. 17, 2006

(51) Int. Cl.
*H04R 25/00* (2006.01)

(52) U.S. Cl. ..... 381/372; 381/370; 381/371

(58) Field of Classification Search ..... 381/370–372
See application file for complete search history.

(56) References Cited

U.S. PATENT DOCUMENTS 4,523,661 A * 6/1985 Scalzo et al. ..... 181/129
5,133,016 A * 7/1992 Clark ..... 381/328
6,731,771 B2 * 5/2004 Cottrell ..... 381/371

* cited by examiner

*Primary Examiner*—Suhan Ni
*Assistant Examiner*—Matthew Eason
(74) *Attorney, Agent, or Firm*—Kevin L. Klug

(57) ABSTRACT

An audio headphone apparatus having ambient noise isolation properties for musicians and sound engineers which allows a user to substantially attenuate ambient noise levels and focus on the electronic audio presented to the headphones. The apparatus utilizes a unique layering of absorber materials with unique geometric shapes which in combination highly attenuate external ambient acoustic energy and control undesirable "boomy" bass response. The apparatus further utilizes a desiccant material within the ear cuff cover which helps to absorb perspiration or other moisture.

7 Claims, 6 Drawing Sheets

AMBIENT NOISE ISOLATION AUDIO HEADPHONES HAVING A LAYERED DAMPENING STRUCTURE

BACKGROUND OF THE INVENTION

The present invention relates in general to audio headphones and more particularly to a set of lightweight and comfortable audio headphones utilizing unique absorption and dampening layers which provide high isolation from ambient surrounding noise. The preferred embodiment provides approximately 29 dB of isolation from ambient noise.

Prior art audio headphones provide sound reproduction for the user but do not provide a substantial isolation from ambient audio levels external to the headphones in a comfortable and lightweight package which controls excessive bass frequencies. That is, prior art headphones often allow the user to hear not only the electronic audio information transmitted into the headphones but also the ambient external sound leaking into said electronic audio. The prior art headphones that do provide isolation are heavy, uncomfortable, and bulky to the user with unacceptable bass or lower midrange resonance. This prior art disadvantage is annoying for musicians, especially drummers, and sound engineers. Musicians are often interested in hearing the blend of their instrument with the accompanying band without their accentuated ambient instrument volume or resonances from the headphones overwhelming what is heard electronically. That is, typically a musician hears the instrument which he or she is playing at a level much greater than other instruments in the accompanying band. This effect is especially true for drummers due to the inherent sound level of the instrument. Without the aid of the present art invention, the musician may lose synchronization and time with other members of the band due to the volume and accentuation of his/her own instrument. The present art device isolates the external ambient environment in order that the musician hears primarily the electronic audio information transmitted into the headphones.

The aforementioned benefits also apply to sound engineers. Sound engineers are often distracted by the ambient noise surrounding the sound board. This often leads to an incorrect mix of the electronic musical audio information which is delivered to the mixing board. The present art invention allows the sound engineer or musician to tap into the mixed electronic audio and ignore the ambient audio which is not in electronic form while providing a desired isolation and frequency response. That is, the audio which the sound engineer or musician hears is the mix which he/she actually desires when recording live performances, studio performances, or practicing with pre-recorded music.

The present invention utilizes a pair of ear cups each having a multilayered material structure within and behind a sealed rearside of an an-isotropic magnet driven speaker which is further placed and mounted within said cup in a non-vented manner. A sound exiting portion of said speaker is covered with a speaker cover or grille cloth. Said speaker and cover are further mounted with an ear cuff frame, preferably via adhesive. The present art further incorporates a desiccant material within the ear cuffs whereby musician perspiration is absorbed.

Prior art audio headphones have not incorporated the external sound attenuation and comfort features found in present art. This is especially true for ear muffs having a very high attenuation level. This is partly due to the requirement that the speaker within said audio headphones often requires reasrside venting to ambient air pressure for optimum sound reproduction. Said venting thereby provides an opportunity for external ambient noise leakage into the electronic speaker sound channel. The an-isotropic magnet driven speakers of the present invention do not require ambient venting for optimum sound reproduction and are thereby sealed within the audio headphone without audio distortion.

Accordingly, it is an object of the present invention to provide lightweight and comfortable audio headphones having ambient noise isolation properties which highly attenuate the external ambient noise while providing high fidelity sound reproduction of the electronic audio signal.

Another object of the present invention is to provide an audio headphone apparatus having ambient noise isolation properties which is convenient, comfortable, and easy to use for musicians and sound engineers.

A further object of the present invention is to use a layered structure which helps control the entrance of external ambient acoustic energy, the exit of internal acoustic energy, and further controls the bass or lower mid-range resonance created within a sealed cavity.

A still further object of the present invention is to comfortably provide a method for musicians to highly attenuate the effect of their own instruments and concentrate on the mixed electronic audio information provided by the audio headphone apparatus while controlling any perspiration emitted by the musician.

A yet further object of the present invention is to comfortably provide a method for sound engineers to highly attenuate the external ambient noise and concentrate on the mixed electronic audio information provided by the audio headphone apparatus without bass resonance effects.

SUMMARY OF THE INVENTION

To accomplish the foregoing and other objects of this invention there is provided an audio headphone apparatus having ambient noise isolation properties which highly attenuate the external ambient noise via a uniquely layered absorption method and limit bass resonance effects, all in a comfortable and lightweight manner. The apparatus and method of use limits user interference from external noise sources and allows the user to hear primarily the electronic information presented by the speakers within the headphones.

In a preferred embodiment, the apparatus comprises a set of user comfortable right and left earpieces connected via a headband and further connected to an external stereo plug through an inline volume control potentiometer. In a preferred embodiment said potentiometer is a linear dual 500 ohm potentiometer, both of which are connected between a stereo channel plug input and the common stereo ground with the wiper of each connected with each speaker respectively. Said headband is adjustable and preferably manufactured from a lightweight high impact plastic with a soft cushion cover. Each earpiece first comprises an ear cup having a liner within the cup cavity and a first, a second, and a star bass absorbing layer behind or at the rearside of a speaker. A speaker cover is placed between the speaker sound exiting portion and an ear cuff mounted with said ear cup. That is, the cuff and cup sandwich all of the aforesaid there between. The speaker and said cover are preferably attached via adhesive to said ear cuff.

In the preferred embodiment, each of said ear cuffs has a cuff pad with a surrounding cuff pad cover and a desiccant board between the cuff pad and a cuff frame. It is a common phenomena for headphone users to perspire at and between the skin/pad cover interface since the soft leatherette material acts a thermal insulator. In the preferred embodiment of the present art, the cuff pad cover is slightly porous and allows user perspiration to migrate into said cuff pad and thereafter be reabsorbed within said desiccant board. Although limited in volume of moisture absorption, the desiccant board helps to maintain a moisture free interface between the cuff pad cover and the user.

Each of said speakers are preferably 64 ohm an-isotropic magnet driven speakers which fit within said ear cups, are enclosed and substantially sealed at said rearside, and are further hard wired to an external stereo plug. An-isotropic magnets provide magnetization primarily upon and through a single axis through the magnetic material to the exclusion of other axis. This property assures that the magnetic material within the speakers maintains the desired magnetic axis during use. This material property is especially useful in headphones where the magnet drives are often of thin sheet magnetic material type. That is, thin sheets of magnetic materials tend to spontaneously magnetize in the direction of the sheet plane. Use of an an-isotropic material with a primary magnetization axis directed orthogonal to said sheet plane assures magnetization in the direction desired and not spontaneously in the direction of the sheet plane.

The an-isotropic magnet driven speakers are of a closed type speaker with no air flow required in the non-audio exiting end or speaker rearside. That is, the speaker rearside is enclosed with a speaker cap which minimizes sound emanation toward the ear cup and maximizes transmission through the speaker sound exiting portion. This allows said speaker to be sealed within said muff and provide the desired isolation, unlike prior art headphones. That is, in order to function properly, prior art headphones utilize speakers which must be vented which further requires slight venting of the ear cups. Those prior art headphones which utilize piezo type speakers lack the full range response present with magnet driven speakers.

A terminal of each an-isotropic magnet driven speaker is electrically connected with a terminal of the other speaker as a common and this common is connected to the ground or common portion of the external plug. Each remaining terminal of each an-isotropic magnet driven speaker is electrically connected to individual portions of the external plug which correspond to the individual stereo channels for each speaker through the volume control potentiometer. This connection method is maintained whether the final connection is a hard wired plug or via a radio frequency or infrared link.

The unique layering structure of the present art utilizes the difference in acoustic impedance between each material or layer to reflect and reabsorb incident acoustic (sound) energy. That is, at the interface between two materials of different acoustic impedance, incident sound reflection occurs. This phenomena is also true if the layers are of a different size even though they may be of the same material and have the same intrinsic material acoustic impedance. By utilizing layers of different size which incorporate air gaps between successive layers, external incident acoustic energy emanating into the headphones is reflected outward and absorbed during the transition between layers, thereby isolating the user's ears from said external ambient. Internal acoustic energy generated by said speakers must also transition through said layers to escape the headphones. Said layer acoustic mismatch and absorption further limits speaker sound from escaping from said headphones.

Directly behind or at the rearside of said speaker is the star bass absorber layer. Said layer comprises an elliptical strip form of approximately the ear cup circumference with a star shaped (preferably four pointed) center connected with said strip. Openings are present between the star shape and the elliptical strip. The star shaped center mounts directly behind said speaker and helps to attenuate the long wavelength bass or low midrange frequencies entering the ear cup cavity. The smaller openings allow the shorter wavelength higher frequencies to transition rearward and reflect from the open air gaps between said star bass absorber and the next layer boundary toward the speaker exiting portion with a minimum of attenuation. The aforesaid bass attenuation minimizes the bass resonance within the cavity. Said bass resonance tends to accentuate the bass frequencies and make the bass sound more "boomy" or overemphasized. The midrange and higher frequencies are able to pass through said openings with a minimum of attenuation.

Acoustic theory places the cutoff wavelength for an orifice opening at approximately twice the dimensional diameter. That is for $\lambda_c$ as the cutoff wavelength of an orifice (i.e. a wavelength greater than which sound cannot pass without attenuation) and d as the diameter dimension of the orifice:

$$\lambda_c \approx 2 \cdot d$$

Rearranging the equation for the present art with an atmospheric (air) speed of sound c at 25 degrees Celsius of approximately 346 meters/second and a major axis gap opening of approximately 0.05 meters and a cutoff frequency of $f_c$:

$$f_c \approx c/2d = 346/(2 \cdot 0.05) = 3460 \text{ hertz}$$

Although an approximation since the gaps are not strictly circular or rectangular, it is clear that the bass frequencies and low midrange frequencies cannot pass through said gaps but instead must pass through the bass absorber layer as a whole and undergo the attenuation which said layer presents.

A further approximation of the lowest resonant frequency of the ear cups further substantiates the star bass absorber layer functionality. That is, it is understood within the acoustic arts that an acoustic cavity with a length l, width w, and depth d will exhibit a resonance frequency $f_R$ at a fundamental 1,1,0 mode as:

$$f_R \approx \frac{c}{2}\sqrt{\frac{1}{l^2} + \frac{1}{w^2} + \frac{0}{d^2}}$$

For the present art ear cups having maximal cross sectional dimensions of length l, width w, and depth d of approximately 0.105, 0.08, and 0.04 meter respectively and a speed of sound c within the layered absorber medium approximated by that of air due to the open cell nature, $$f_R \approx 2719 \text{ hertz}$$

Accepting the limitations of the aforesaid approximation, the cavity fundamental bass and low midrange resonance is below the cutoff frequency of the openings within the star bass absorber layer. This assures that the especially "boomy" or excessive bass response of the headphones is minimized.

The method and operation of use especially anticipates use by musicians and sound engineers. That is, in operation the musician first places the headphones over the ears in the proper right-left orientation and plugs the external plug into the mixed electronic audio output. The user begins play with other musicians or a prerecorded accompaniment and focuses on his/her contribution made to the mixed audio rather than the accentuated ambient instrument volume of the individual musician. The aforesaid ensures that the musician stay in tune and in time with his accompanying musicians. The foregoing method also applies to sound engineers. Following the same procedure, the sound engineer is able to ignore the ambient and concentrate on the electronic mix whereby he/she is able to optimize the same. The isolation provided by the art of the present invention allows loud instruments to be played within the same room as the mixing board or multitrack recorder and further allows the musician to be his or her own sound mixing engineer. The aforesaid eliminates the need for musician placement or isolation within a separate enclosed area.

In the preferred embodiment, the cups, cuffs, and headband are manufactured from a lightweight plastic material, the absorber and pad materials utilize a flexible urethane foam or felt where described, and the cuff pad cover and headband are a vinyl leatherette material. Alternative embodiments may utilize a plurality of materials including but not limited to leathers, plastics, metals, woods, ceramics, laminates, or composites where structurally and acoustically able to perform as described with the preferred embodiment.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
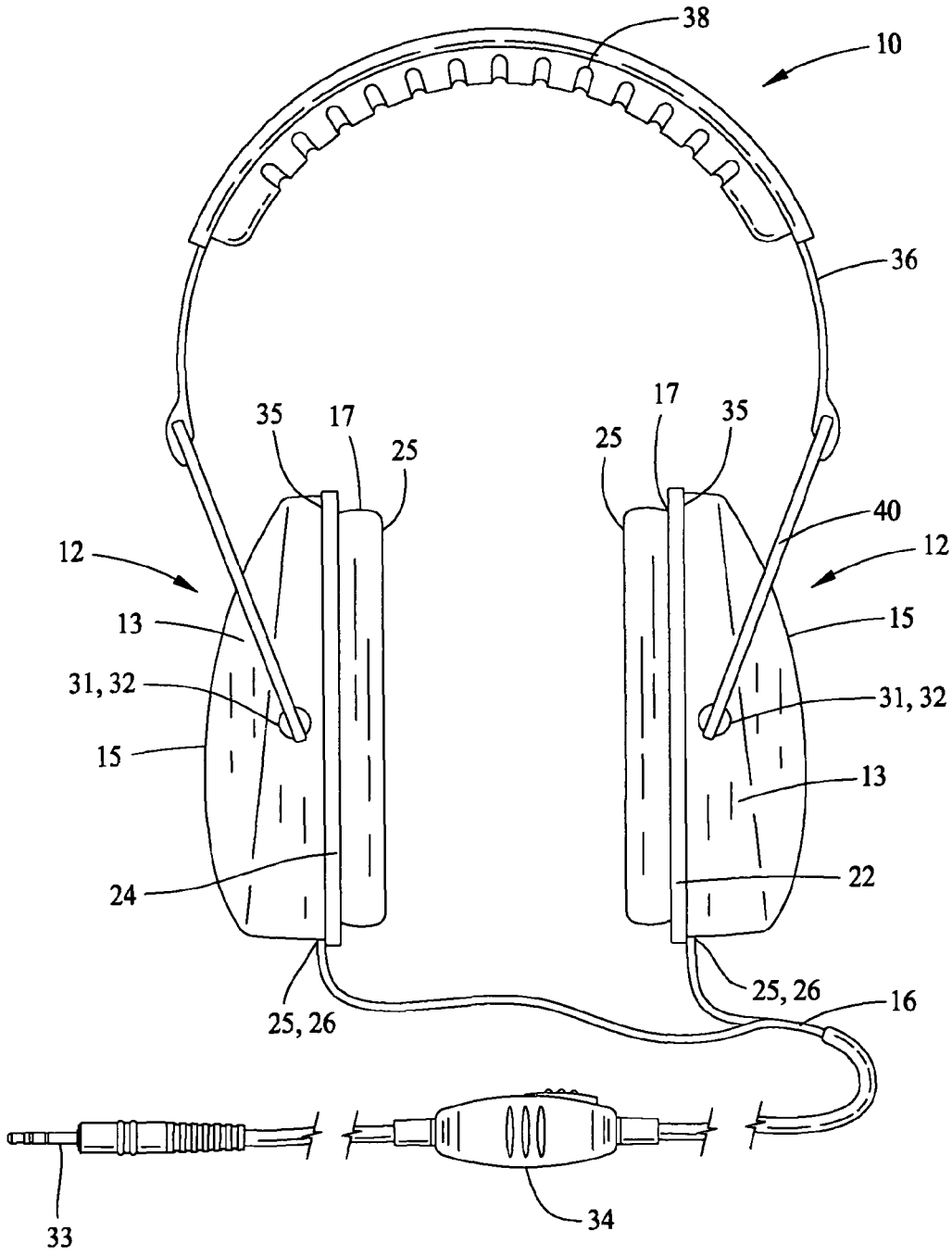
FIG. 1 represents a front perspective view of the ambient noise isolation audio headphones having a layered dampening structure.
Figure 2:
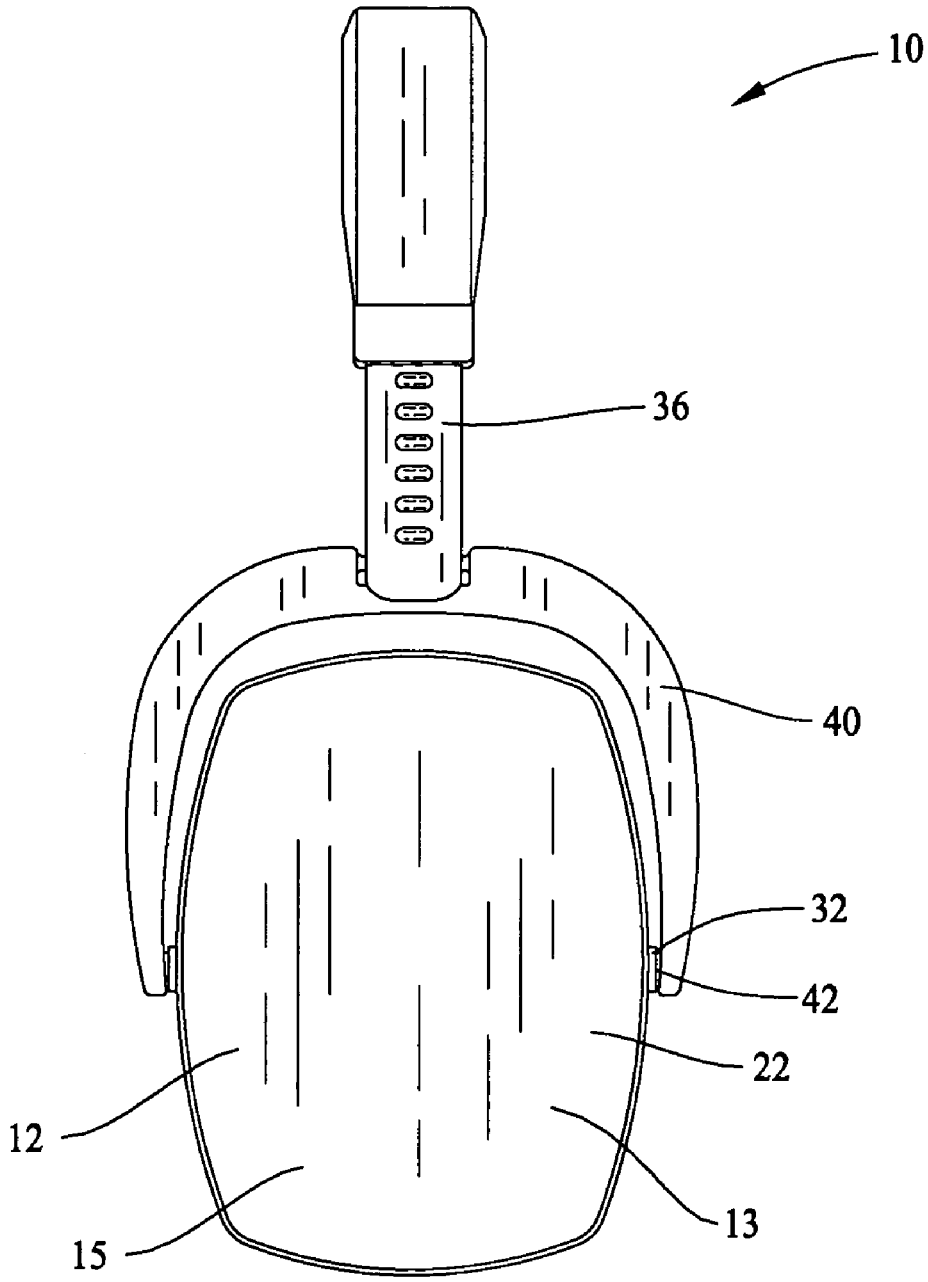
FIG. 2 shows a right side perspective view thereof
Figure 3:
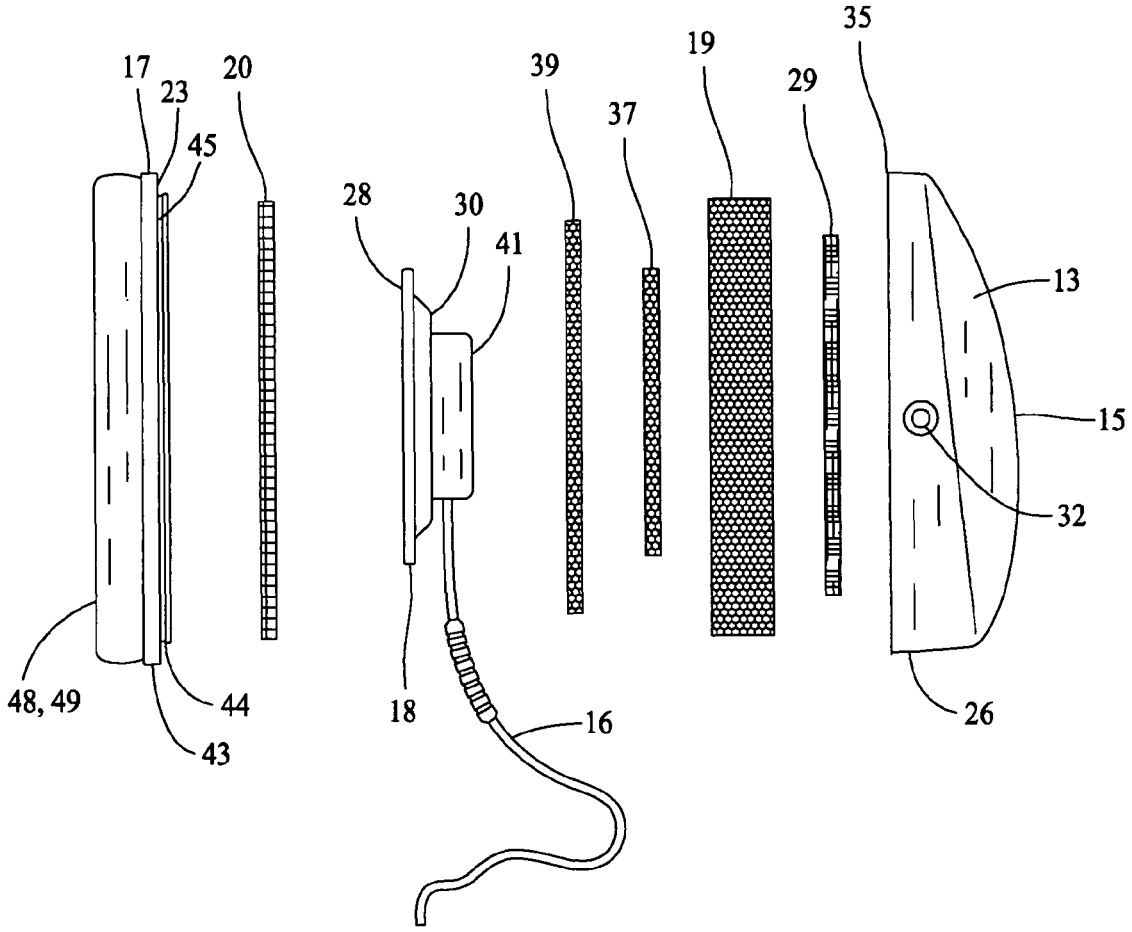
FIG. 3 shows an exploded plan view of an earpiece thereof in a disassembled form.
Figure 4:
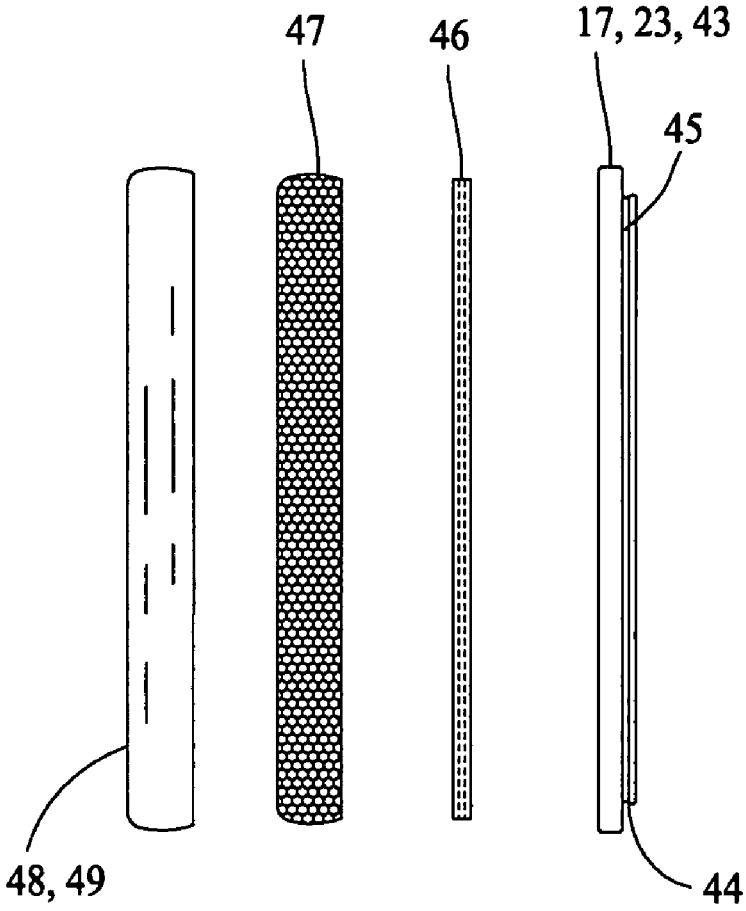
FIG. 4 is an exploded plan view of an earcuff thereof showing the cuff frame, cuff pad, cuff pad cover, and desiccant board.
Figure 5:
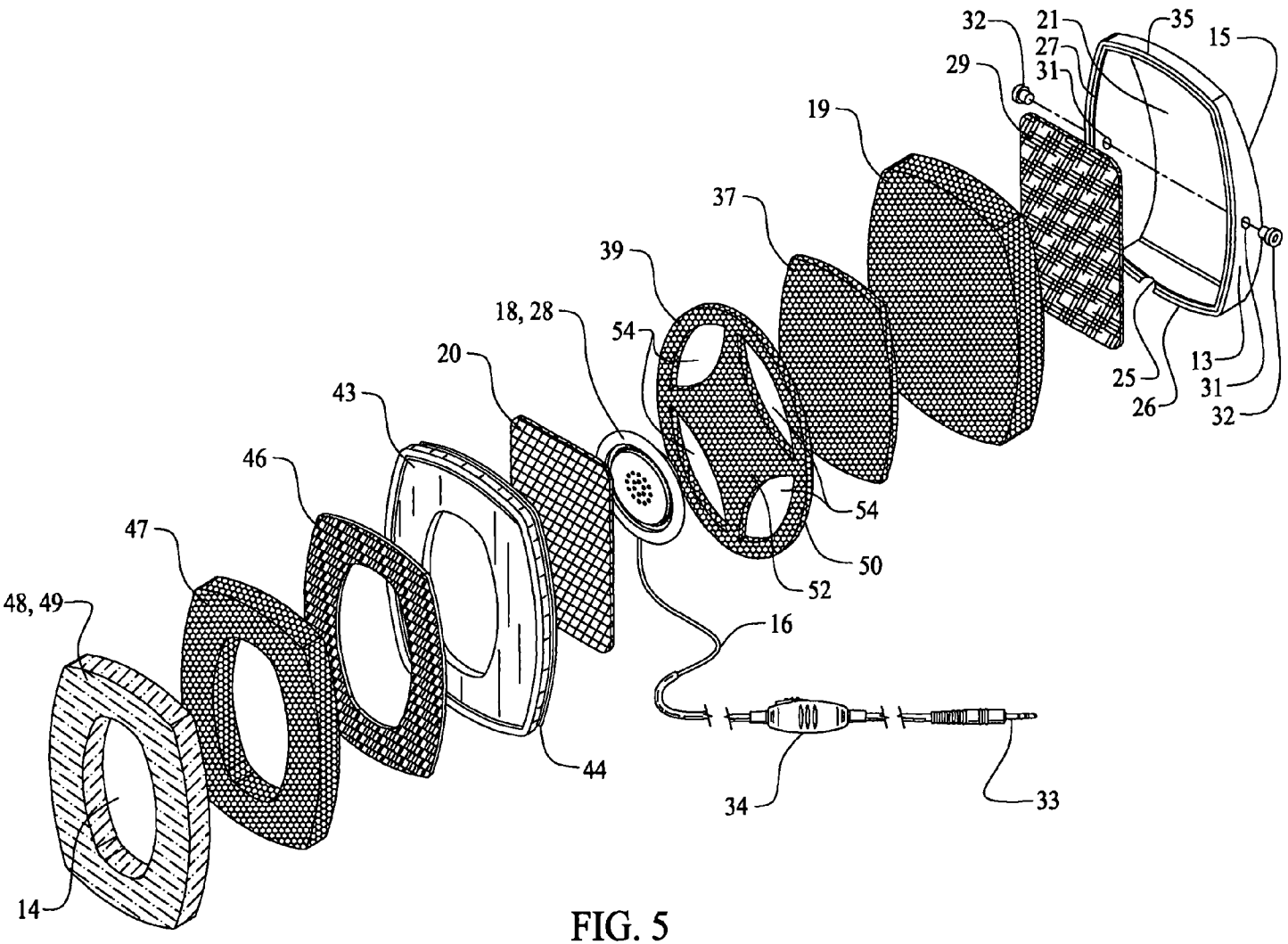
FIG. 5 shows an exploded perspective assembly view of an earpiece thereof in a disassembled form.
Figure 6:
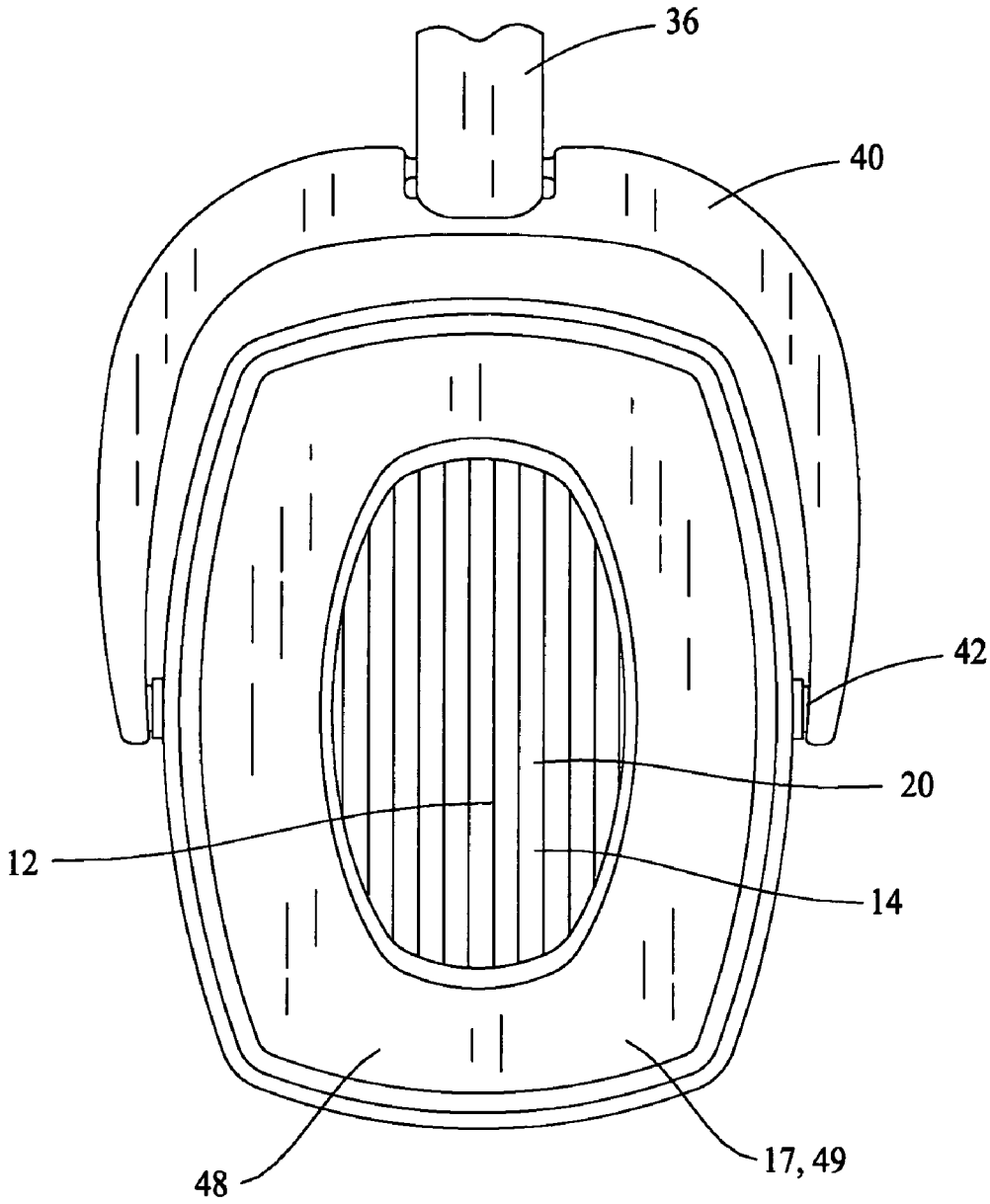
FIG. 6 shows an internal plan view of an assembled earpiece and partial headband thereof looking into the ear cuff portion.

Referring now to the drawings, there is shown in FIGS. 1-6 an audio headphone apparatus having ambient noise isolation properties 10. The audio headphone apparatus having ambient noise isolation properties 10 with its uniquely layered absorbing structure is particularly adapted for minimizing external ambient noise interference with the electronic audio signal provided.

The drawings show the preferred apparatus comprising a high isolation earmuff 12 and one or more non-vented an-isotropic magnet driven speakers 18 placed within said earmuff 12 with an external plug 33, preferably stereo, electrically connected through a volume control 34 potentiometer with said speakers 18. The audio headphones 10 have a right earpiece 22, a left earpiece 24, and a headband 36. Said headband 36 is adjustable and preferably molded of a lightweight plastic material and further comprises a cushioned soft headpad 38 with band forks 40. Each of said band forks 40 have protrusions 42 which mate with headband bushings 32 which are frictionally held within wall holes 31 of the ear cups 13 of each of said earpieces 22, 24. Also in a preferred embodiment, said bushings 32 are sealed at an end within said cups 13 whereby sound leakage is minimized. Preferably said bushings 32 are a rubber like material of a low "A-scale" durometer value whereby a pressed seal is assured and maximum sound attenuation is achieved relative to ambient.

In the preferred form, each earpiece 22, 24 comprises an ear cup 13 having an outer wall 15 into which said wall holes 31 are formed, a cavity 21, a base 26, and an circumference 35. The preferred embodiment also has a notch 25 in said base 26 through which a coated wire 16 may be threaded and held to feed each speaker 18. Preferably, each cup 13 circumference 27 also has a lip 27 which mates with and holds an ear cuff 17.

Also within the preferred embodiment, within each cavity 21 and onto or adjacent to said outer wall 15 is first placed a liner 29, preferably of 1/16 inch felt, which acts as a first layer ambient noise protection absorber. A first absorber 19, preferably of ½ inch flexible polyurethane open cell foam, of approximately the same width, length, and contour size as said circumference 35 is then placed over said liner 29 within said cavity 21. A second absorber 37, preferably of ⅛ inch flexible polyurethane open cell foam, of substantially smaller size than said circumference 35, is thereafter centered and placed over said first absorber 19. The size of this second absorber 37 assures an air gap between said first absorber 19 and the subsequent star bass absorber 39. Said air gap maximizes the acoustic impedance difference between successive absorber 19, 37, 39 layers whereby substantial sound reflection is achieved in any direction of travel.

The star bass absorber 39, preferably also of ⅛ inch flexible polyurethane open cell foam, is placed over this second absorber and acts to minimize the "boomy" bass which is present within the closed and sealed ear cup 13 cavity 21. In a preferred embodiment, the star bass absorber 39 comprises an elliptical strip 50 form of approximately the ear cup circumference 35 and about ⅛ inch width with a star shaped (preferably four pointed) center 52 connected with said strip. Elliptical like openings 54 are present between the star shape 52 and the elliptical strip 50 in order to allow transmission of higher frequency audio and force attenuation of lower frequency audio, especially bass resonance. In the preferred embodiment, said openings are approximately 5 centimeters in width by approximately 2 centimeters in height. The star shaped center 52 mounts or positions directly behind said speaker 18, assures a positive sandwich between said speaker and said ear cuff 17, and also allows the outer non-center portions of said speaker 18 to vibrate at said openings 54. For all absorber 19, 37, 39 layers, the energy absorbing foam material is a high acoustically attenuating material which along with the remaining portions of said muff 12 provides the desired ambient noise attenuation.

Each speaker 18, preferably a non-vented an-isotropic magnet driven speaker, is placed onto said star bass absorber 39 with a speaker rearside 30 and speaker cap 41 touching the same and thereafter sandwiched therein by said ear cuff 17. Preferably said speaker is adhesively attached with said cuff 17. The speaker cap 41 engages and locks with said speaker rearside 30 whereby the an-isotropic magnet voice coil is sealed within a cavity within the cap 41. This seal assures minimal interference between the voice coil and other components and also maximizes sound transmission from the sound exiting portion 28 toward and into said ear cuff 17.

A speaker cover 20 is placed between said sound exiting portion 28 and said ear cuff 17 and covers the ear cavity 14 within each cuff 17. Preferably said speaker cover 20 is a 1/16 inch speaker grille cloth material which is designed to allow acoustic energy to pass through with a minimum of attenuation and distortion. In the preferred embodiment, said speaker cover 20 is adhesively attached to said cuff 17.

Each ear cuff 17 has a backside 23 having a cuff frame 43 with a rib 44 and a channel 45 therein which mates with the lip 27 of said ear cup 13 circumference 35 and thereby holds the absorber 19, 37, 39 layers, speaker 18, and liner 29 intimately together. The frontside 48 of said cuff frame 43 has a cuff foam pad 47 and cuff pad cover 49 adhesively mounted thereon. Said cuff pad cover 49 completely surrounds said cuff foam pad 47 and is preferably adhesively bonded with said cuff frame 43. Also in the preferred embodiment, between the cuff foam pad 47 and the cuff pad cover 49 nearest said cuff frame 43 is a desiccant board 46 of approximately 0.015 inch thickness. This allows any user perspiration moisture which leaches through the slightly porous cover 49 and into the cuff foam pad 47 to be reabsorbed into the desiccant 46 via the wick effect. Alternative embodiments may utilize a plurality of forms, shapes, and placements of said desiccant 46, whether in board form or not.

The aforesaid muff 12 with its unique structure provides approximately 29 dB of attenuation from ambient noise. Alternative embodiments may substitute other high acoustically attenuating materials which function in a similar manner. Said outer wall 15 forms the cup 13 and is preferably molded of a thin polymer material, although other materials such as metals, woods, composites, or ceramics may be utilized. Alternative embodiments may incorporate other types of high isolation muffs 12 or speakers 18, provided the speakers 18 are capable of high fidelity sound reproduction in a sealed and non-vented enclosure. When assembled with the aforesaid speakers 18, the headphones 10 in combination with the cups 13 comprise a right earpiece 22 on the right side and a left earpiece 24 on the left side.

Preferably each of said speakers 18 is attached to the backside 23 of each ear cuff 17 assembly with an adhesive but may be attached with other means such as mechanical fasteners, slip fits, or simply sandwiched between the ear cuffs 17 and the ear cavities 14. The frontside 48 of each cuff pad cover 49 touches with the user's head and flexibly contours via said foam pad 47. In the preferred embodiment, the notch 25 is placed within the base 26 of said outer wall 15 for threading of the driving wire 16 which powers each of said speakers 18. Alternative embodiments may provide other methods of routing the drive wire 16 external to the ear cavities 21, such as holes, integral moldings, molded through conductors, or sandwiches between the cuffs 17 and the ear cups 13.

The speaker cover 20 is preferably manufactured of an audio permeable type material such as felt, but may utilize other audio permeable materials in alternative embodiments. Said absorbers 19, 37, 39 are preferably an open cell foam but may comprise a plurality of other types of acoustically absorbing materials including but not limited to closed cell foams, styrofoams, cloths, rubbers, plastics, woods, and leathers.

As understood within the art, each speaker 18 has two drive terminals and each are wired as customary in the art. Two wires 18, preferably in a single sheath, attach to each speaker 18 and exit each ear cavity 14. A terminal of each speaker 18 is then electrically connected with a terminal of the other speaker 18 as a common and this common is electrically connected to the ground or common portion of the external plug 33. Each remaining terminal of each speaker 18 is then electrically connected to the individual or non-common portions of the external plug 33 which correspond to the individual stereo channels for each speaker 18 through each potentiometer of said volume control 34. This holds true whether the connection is hard wired or via a radio frequency or infrared link.

In operation the user first determines the right earpiece 22 and then places the headphones 10 over the ears in the proper right-left orientation and plugs the external plug 33 into the mixed electronic audio output. The user begins play with other musicians or a prerecorded accompaniment or begins another musical operation and focuses on his/her contribution made to the mixed audio rather than the accentuated ambient instrument volume of the individual musician. The aforesaid ensures that the musician stays in tune and in time with his accompanying musicians. The foregoing method also applies to sound engineers. Following the same procedure, the sound engineer is able to ignore the ambient and concentrate on the electronic mix or another musical operation whereby he/she is able to optimize the same.

From the foregoing description, those skilled in the art will appreciate that all objects of the present invention are realized. A comfortable and easy to use audio headphone apparatus having ambient noise isolation properties of approximately 29 dB and bass resonance control has been shown and described. The apparatus of this invention is able to provide isolation from ambient noise of approximately 29 dB and eliminate unwanted bass resonance effects while providing the comfort level desired.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. An ambient noise isolation audio headphone comprising:

one or more earpieces, each having an ear cup; and said ear cup having an outer wall, a sealed cavity, and a circumference; and a liner adjacent to said outer wall within said cavity and said liner having a first thickness and acting as a first layer ambient noise protection absorber; and a first absorber of a flexible polyurethane open cell foam having a second thickness and having approximately a contour size of said circumference and placed over said liner within said cavity; and a second absorber having a third thickness less than said second thickness and of a substantially smaller size than said circumference and centered and placed over said first absorber; and a bass absorber placed over said second absorber and having a fourth thickness and an elliptical strip form of approximately said ear cup circumference and a star shaped center connected with said elliptical strip form and having openings between said star shaped center and said elliptical strip whereby a higher frequency audio energy having a wavelength of approximately half or less than a dimension of said opening may pass through said bass absorber with minimal attenuation and attenuate a bass resonance frequency audio; and an air gap between said first absorber and said bass absorber due to said second absorber having said smaller size than said circumference wherein an acoustic impedance difference between said first absorber, said second absorber, and said bass absorber is maximized and a substantial sound reflection is achieved; and a non-vented an-isotropic magnet driven speaker having a sound exiting portion and a speaker rearside having a speaker cap, said speaker rearside positioned to face said cavity; and said star shaped center positioned directly behind said speaker rearside and contacting said speaker cap; and said openings of said bass absorber allowing one or more outer non-center portions of said speaker to vibrate at said openings; and an ear cuff having a backside, a cuff frame, a cuff pad, a cuff pad cover, an ear cavity, and a frontside; and said ear cuff backside mated with said ear cup wherein said sound exiting portion of said speaker may transmit through said ear cavity; and a speaker cover of a cloth material placed between said sound exiting portion and said ear cuff whereby said first absorber, said second absorber, said bass absorber, said speaker, and said liner are held together.

2. The ambient noise isolation audio headphone of claim 1 whereby:

said liner is of a material having a different acoustic impedance than said first absorbers.

3. The ambient noise isolation audio headphone of claim 1 further comprising:

a desiccant board within said cuff pad cover; and said cuff pad cover of a permeable material whereby moisture permeating through said cover is absorbed by said desiccant via a wick effect.

4. The ambient noise isolation audio headphone of claim 3 whereby:

said desiccant board within said cuff pad cover is between said cuff pad and said cuff frame.

5. The ambient noise isolation audio headphone of claim 2 further comprising:

a desiccant within said cuff pad cover; and said cuff pad cover of a permeable material whereby moisture permeating through said cover is absorbed by said desiccant via a wick effect.

6. The ambient noise isolation audio headphone of claim 5 whereby:

said desiccant board within said cuff pad cover is between said cuff pad and said cuff frame.

7. The ambient noise isolation audio headphone of claim 6 whereby:

said liner is of a felt material and said first thickness is approximately one sixteenth inch; and said first absorber second thickness is approximately one half inch; and said second absorber third thickness is approximately one eighth inch; and said bass absorber fourth thickness is approximately one eighth inch open cell foam material.

* * * * *